US010429008B2

(12) United States Patent
Chang et al.

(10) Patent No.: US 10,429,008 B2
(45) Date of Patent: Oct. 1, 2019

(54) PRISMATIC PRESSURE TANK HAVING LATTICE STRUCTURE

(71) Applicant: KOREA ADVANCED INSTITUTE OF SCIENCE AND TECHNOLOGY, Daejeon (KR)

(72) Inventors: Dae Jun Chang, Ulsan (KR); Pal G Bergan, DaeJeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 15/239,159

(22) Filed: Aug. 17, 2016

(65) Prior Publication Data

US 2016/0356420 A1 Dec. 8, 2016

Related U.S. Application Data

(62) Division of application No. 14/110,580, filed as application No. PCT/KR2012/003157 on Apr. 25, 2012.

(30) Foreign Application Priority Data

Apr. 25, 2011 (KR) ..... 10-2011-0038676
Apr. 25, 2011 (KR) ..... 10-2011-0038678
Apr. 25, 2011 (KR) ..... 10-2011-0038681

(51) Int. Cl.
*F17C 1/08* (2006.01)
*F17C 3/02* (2006.01)
(Continued)

(52) U.S. Cl.
CPC ..... *F17C 1/08* (2013.01); *F17C 1/02* (2013.01); *F17C 1/12* (2013.01); *F17C 3/025* (2013.01);
(Continued)

(58) Field of Classification Search
CPC .. F17C 1/00; F17C 1/002; F17C 1/005; F17C 1/007; F17C 1/02; F17C 1/04; F17C 1/08;
(Continued)

(56) References Cited

U.S. PATENT DOCUMENTS 1,477,686 A * 12/1923 Braender ..... B64D 37/06 138/148
3,414,153 A * 12/1968 Leroux ..... B65D 88/02 220/506
(Continued)

FOREIGN PATENT DOCUMENTS

CN 101014800 8/2007
EP 0166492 1/1986
(Continued)

OTHER PUBLICATIONS

European Search Report—European Application No. 12777631.8 dated Jul. 3, 2015, citing U.S. Pat. No. 3,414,153, WO 2008/103053, WO 2006/001711, U.S. Pat. No. 1,477,686, FR 1 591 601, EP 0 166 492 and KR 2009 0046604.
(Continued)

*Primary Examiner* — Steven A. Reynolds
*Assistant Examiner* — Javier A Pagan
(74) *Attorney, Agent, or Firm* — Cantor Colburn LLP

(57) ABSTRACT

Provided is a pressure tank having a lattice structure, including: a tank body that has a high-pressure fluid accommodated therein and is manufactured to have a prismatic shape; and cell structures that are disposed in the prismatic tank body, are manufactured in a lattice form, arrive from one side wall of the tank body to the other side wall thereof facing it, and are orthogonally arranged regularly.

12 Claims, 17 Drawing Sheets

(51) Int. Cl.
*F17C 1/02* (2006.01)
*F17C 1/12* (2006.01)
*F17C 13/02* (2006.01)

(52) U.S. Cl.
CPC ..... *F17C 13/02* (2013.01); *F17C 2201/0157* (2013.01); *F17C 2201/0161* (2013.01); *F17C 2201/0166* (2013.01); *F17C 2201/0171* (2013.01); *F17C 2201/052* (2013.01); *F17C 2203/013* (2013.01); *F17C 2203/0304* (2013.01); *F17C 2203/0345* (2013.01); *F17C 2203/0629* (2013.01); *F17C 2209/221* (2013.01); *F17C 2221/033* (2013.01); *F17C 2223/0161* (2013.01); *F17C 2223/033* (2013.01); *F17C 2223/035* (2013.01); *F17C 2250/04* (2013.01); *F17C 2250/0452* (2013.01); *F17C 2250/0491* (2013.01); *F17C 2260/011* (2013.01); *F17C 2260/016* (2013.01); *F17C 2270/0105* (2013.01)

(58) Field of Classification Search
CPC ..... F17C 1/10; F17C 1/12; F17C 1/14; F17C 1/16; F17C 3/00; F17C 3/02
USPC ..... 220/581, 585, 586, 592
See application file for complete search history.

(56) References Cited

U.S. PATENT DOCUMENTS

| | | | | |
|---|---|---|---|---|
| 3,528,582 | A | 9/1970 | Rigollot | |
| 3,680,275 | A * | 8/1972 | Romlet | B65D 88/78 220/555 |
| 5,647,503 | A * | 7/1997 | Steele | B29C 70/24 220/589 |
| 2004/0188446 | A1 | 9/2004 | Gulati et al. | |

FOREIGN PATENT DOCUMENTS

| | | | | |
|---|---|---|---|---|
| FR | 1591601 | | 5/1970 | |
| JP | 54002507 | | 1/1979 | |
| JP | 2008503703 | | 2/2008 | |
| KR | 1020090046604 | | 5/2009 | |
| WO | 2005085099 | | 9/2005 | |
| WO | 2006001711 | | 1/2006 | |
| WO | 2008103053 | | 8/2008 | |
| WO | WO 2008103053 | A1 * | 8/2008 | B63B 25/16 |
| WO | WO-2008103053 | A1 * | 8/2008 | B63B 25/16 |
| WO | 2009140692 | | 11/2009 | |

OTHER PUBLICATIONS

International Search Report—PCT/KR2012/003157 dated Jan. 3, 2013.

* cited by examiner (a)

(b)

PRISMATIC PRESSURE TANK HAVING LATTICE STRUCTURE

CROSS-REFERENCE TO RELATED APPLICATIONS

This application is a divisional application of U.S. Ser. No. 14/110,580, filed on Oct. 8, 2013, which is a national entry of PCT Application No. PCT/KR2012/003157 filed on Apr. 25, 2012, which claims priority to and the benefit of Korean Application No. 10-2011-0038676 filed on Apr. 25, 2011, Korean Application No. 10-2011-0038678 filed on Apr. 25, 2011 and Korean Application No. 10-2011-0038681 filed on Apr. 25, 2011, in the Korean Patent Office, the entire contents of which are incorporated herein by reference.

TECHNICAL FIELD

The present invention relates to a pressure tank, and particularly, to a pressure tank having a lattice type internal load carrying structure, in which the pressure tank is manufactured in mainly a hexahedral shape and where the enclosing tank walls are reinforced for lateral pressure by way of stiffening members consistent with the lattice structure to withstand pressure by internal fluid and is manufactured in a mainly prismatic shape to increase volumetric efficiency in relation to the surrounding space

BACKGROUND ART

Generally pressure vessels and tanks with substantial internal pressure are designed with shape of a complete sphere or a cylinder with doubly curved end enclosures. The main way of carrying the internal pressure in such tanks is by way of membrane stresses in the curved tank walls. Bending stresses in the tank walls are preferably avoided since that reduces the load carrying efficiency for a given wall thickness. A typical trait by membrane type tanks is that the wall stress, and thereby also the wall thickness increases proportionally with the radius of curvature as well as the internal pressure itself whereas the membrane stress is inversely proportional to the wall thickness. For practical reasons, such as practically of welding, the wall thickness has to be limited to a few centimeters for steel tanks. This implies that membrane type shells cannot be made very big when the internal design pressure is large. Another aspect with such pressure vessels is that such tanks cannot be made as a complete double barrier tank without having one complete tank within another complete tank, thereby more than doubling the amount of material required.

The current invention targets tanks that can sustain significant pressures as well as sustaining temperature well below ambient temperature. Low temperature tanks are used for instance for storing Liquid Natural Gas (LNG) both on land as well as onboard ships and offshore installations. Examples of such LNG tanks are cylindrical concrete-steel double barrier tanks for land storage and double barrier membrane and partial double barrier spherical tanks for transportation of LNG onboard ships. Such tanks are not suited significant internal pressure and normally operate at atmospheric pressure. With current attention to the potential environmental advantages by using natural gas for fuel onboard oceangoing vessels there is clearly a need for large fuel tanks of order 1000 to 8000 $m^3$ that can operate with temperatures down to −163 degrees C. and internal pressures of up to 15 bar. These objectives cannot be met with the types of tanks mentioned in the preceding whereas the current invention can meet these requirements as well as even more severe challenges in terms of size, pressure and thermal versatility. Moreover, the current pressure vessel concept can be made double barrier in terms of leak containment as well as double full pressure barrier. It is also easy to insulate the tank on the outside. FIG. 1 is a diagram showing a pressure tank according to the related art, (a) of FIG. 1 is a spherical pressure tank, (b) of FIG. 1 is a cylindrical pressure tank, (c) of FIG. 1 is a lobe-type pressure tank, and (d) of FIG. 1 is a cellular type pressure tank.

The overall efficiency of a tank may be characterized by the volume efficiency and the material ratio.

$$\xi = \frac{V_{tank}}{V_{prism}} \quad \text{[Equation 1]}$$

Equation 1 expresses the volume efficiency. Here, $\xi$ represents volume efficiency, $V_{tank}$ represents the actual volume of the tank, and $V_{prism}$ represent the volume of an ideal rectangular parallelepiped or prism (brick shape) volume surrounding the tank.

The higher the value of $\xi$, the better is the storage efficiency of the tank in relation to utilization of the total, brick shaped outer space occupied by one or several tanks. Note that the volume efficiency of a rectangular, prismatic (brick) shape tank is 1.

$$\eta = \frac{V_{material}}{V_{stored}} \quad \text{[Equation 2]}$$

Equation 2 expresses the material ratio. Here, $\eta$ represents a material ratio whereas $V_{material}$ expresses the actual volume of the material used for making the tank, and $V_{stored}$ represents of the gross volume for storing fluid in the tank. p is the internal pressure and $\sigma_a$ is the uniaxial, allowable stress. The lower the value of $\eta$, the smaller the amount of material is necessary for building the tank in relation to the volume stored, and thus, the better is the structural efficiency of the tank.

TABLE 1

| Type of Pressure tank | $\xi = \frac{V_{tank}}{V_{prism}}$ | $\eta = \frac{V_{material}}{V_{stored}}$ |
|---|---|---|
| Spherical Type | 0.52 | 1.5 |
| Cylinder Type | 0.78 | 1.73-2.0 |
| Lobe Type | 0.85 | 1.73-2.0 |
| Cellular Type ((d) of FIG. 1) | <1.0 | 1.73-2.0 |

The Table 1 is a table representing the volume efficiency and the material ratio of the tank according to the related art. Note that the material used for the end capping of the cylindrical, lobe and cell type tanks are not included. Moreover, the best material performance is obtained when assuming that the deviatory stress criterion applies (von Mises stress) in connection with allowable stress; this is due to that the hoop stress in these tanks is exactly twice the longitudinal stress.

As seen from the table the spherical tanks have the best material performance; unfortunately, their volume efficiency is very poor. This means that it is not possible to utilize a high portion of a given outer, surrounding volume for actual storage within a series of spherical tanks.

As can be appreciated from the Table 1, the cellular type tank has the most efficient volume efficiency and the material ratio has a value similar to the cylindrical type tank, the lobe type tank, and the cellular type tank.

However, since the lobe type tank is manufactured by intersecting circular tank with each other as well as with cylindrical and planar tank walls, it is difficult to manufacturing such type of tank. High stresses will typically be concentrated at the intersecting lines between internal bulkhead, cylindrical parts and doubly curved parts, which may greatly reduce the material efficiency of such tanks. In practice it is not possible to make a high pressure lobe tank as a double barrier tank because of geometrical complexity.

The cellular type tank has high volume efficiency because of the repetitive cells in two directions. Its material ratio is also good in that it corresponds to that of cylindrical tanks. A main drawback with cellular tanks is that it is difficult to design good ways of closing the ends of the cells without creating significant local bending deformations and stress concentrations. Further, there is a problem in that it is difficult to form the outer wall of the cellular type tank as a double wall in connection with a design.

SUMMARY OF THE INVENTION

An object of the present invention is to provide a new type of high-pressure tank having a mainly rectangular, prismatic shape, that is, a pressure tank with a very high volume efficiency and at the same time be capable of enduring high pressure of a fluid and change in temperature while enabling to make the tank of any size by modular extension in any of the three spatial directions.

Further, another object of the present invention is to provide a pressure tank including high volume efficiency and preventing a fluid in the pressure tank from being leaked by allowing for integration of a secondary barrier.

Another object of the invention is to provide a tank that is suitable for allowing any level of fluid filling and being able to withstand very large dynamic motions of the tank by way of effective fluid damping from the internal load carrying structure and by having strong tank walls that can sustain dynamic fluid pressures from sloshing.

Still another object is to provide a pressure tank concept that is modular and scalable to any size by use of repetitive, modular elements throughout the interior of the tank as well as in the external walls.

A final objective is to provide a flexible concept for the interior load carrying structure such that it can be designed for almost any level of interior pressure by selection of the dimensions of the load carrying structure including selection of appropriate modular distance between structural elements.

In one general aspect, a pressure tank having a lattice structure, comprising: a tank body 50 that has a high-pressure fluid accommodated therein and is manufactured to have a prismatic shape; and cell structures 1000 that are disposed in the tank body 50, are manufactured in a lattice form, arrive from one side wall of the tank body 50 to the other side wall thereof facing it, and are orthogonally arranged regularly.

The cell structures 1000 may include surface lattice structures 100 that are manufactured in a shape in which flat cell walls 120 intersect each other to endure pressure load, and the flat cell walls 120 are provided with a plurality of holes (not shown) to freely move a fluid among cells.

The cell structure 1000 may include beam structures 200 that arrive from one side wall of the tank body 50 to the other side wall thereof facing it and are orthogonally arranged regularly.

The beam structures 200 are manufactured in branching type beam structures 220, 230, 240, 250, and 290, which include beams extending in a three-dimensional orthogonal coordinate system (X, Y, and Z) structure.

Each beam of the beam structure 220 has a rectangular cross section.

Each beam of the beam structure 290 has an X-shaped cross section.

Each beam of the beam structure 230 may have a circular cross section and a diameter of a cross section of a Z-axis beam structure 233 may be larger than those of sections of X-axis and Y-axis beam structures 231 and 232.

The beam structure 240 includes a combined beam structure node or joint 241 that is manufactured in a hollow shape based on an original point, the combined beam structure 240 being formed by inserting and welding, screwing or other types of bonding of a beam 242 into the combined beam structural node 241. Prefabricated nodes of this type may be made by casting or forging of materials such as steel, alloy or composites.

The beam structures 200 are offset beam structures 250 that are manufactured in an offset structure at internal nodes 214.

The tank body 50 includes an inner wall 20 contacting the beam structures 200 and an outer wall 30 positioned at a predetermined distance from the inner wall.

The beam structures 200 are formed so that a length from portions at which the beam structures 200 contact an inner side of the inner wall 20 to the intersecting parts 214 is longer than the internal lattice unit lengths.

A plurality of beam-wall brackets 22 that are welded into an intersecting part of the beam structure 200 and the inner side of the inner wall 20, and a plurality of beam-beam brackets 24 that are welded into an intersecting part of the beams The plurality of girders 40 having a plate shape are disposed between the inner wall 20 and the outer wall 30, the girders 40 contacting an outer side of the inner wall 20 to correspond to portions at which the beam-wall brackets 22 contact the inner wall 20 and the other sides thereof contacting an inner side of the outer wall 30.

The plurality of girders 40 are disposed between the inner wall 20 and the outer wall 30, top surfaces of the girders 40 contact an outer side of the inner wall 20 to correspond to a portion at which a wall stiffening member 21 contacts the inner wall 20, and flanges 41 of the girders 40 are welded to the plurality of outer walls 30.

The beam structures 200 include a plurality of H-type beam structures 260 that arrive from one side wall of the tank body to the other side wall thereof facing it, are orthogonally arranged regularly, and have I-type or H-type sections.

Ends of the H-type beam structures 260 are provided with an outer wall cover plate 270 to form the outer wall 30 of the pressure tank and central portions 261 of the H-type beam structures 260 having side portions contacting the outer wall 30 extend vertically to form the inner wall 20 of the pressure tank 10, the inner wall 20 and the outer wall 30 being made of a material having pressure-resistant property and being suitable for the applicable operational temperatures.

The cell structures 100 include beam surface structures 300 having flat cell walls 320 that arrive from one side wall of the tank body 50 to the other side wall thereof facing it and are orthogonally arranged regularly to intersect with each other and cell beams 330 that are positioned at a point at which the cell walls 320 intersect each other.

The cell walls 320 are provided with quadrangular cell wall holes 324 of which the corners are rounded.

The pressure tank may further comprising: surface stiffening members 23 that contact top surfaces or bottom surfaces of the cell walls 320 and are orthogonally arranged regularly at boundary surfaces of the cell wall holes 324 to intersect with each other, and the surface stiffening members 23 are manufactured to have girders with flanges.

The cell beams 330 are manufactured as branching type cell beams 334, 335, and 336, the branching type cell beams 334, 335, and 336 include beams that extend in a three-dimensional orthogonal coordinate system (X, Y, and Z) structure.

The cell beams 330 are manufactured as circular cell beams 334 each having circular sections, diamond-shaped cell beams 334 each having diamond-shaped sections and corners of the diamond-shaped cell beams 335 contact the cell walls 320, or X cell beams 336 each having "X" shaped cross sections and side portions of the X cell beams 336 contact the cell walls 320.

The tank body 50 includes an inner wall 20 contacting the cell structures 1000 and an outer wall positioned at a predetermined distance from the inner wall.

At least one of an inner side of the inner wall 20, an outer side of the inner wall 20, an inner side of the outer wall 30, and an outer side of the outer wall 30 is provided with the wall stiffening member 21 having a lattice form, the wall stiffening member 21 is manufactured to be a girder with flanges and has an upper surface joined to the inner wall 20 or the outer wall 30.

A plurality of girders 40 having a plate shape are disposed between the inner wall 20 and the outer wall 30, the girders 40 contacting the outer side of the inner wall 20 to correspond to portions at which the cell structures 100 contact the inner wall 20 and the other sides thereof contacting the inner side of the outer wall 30.

The plurality of girders with flanges 40 are disposed between the inner wall 20 and the outer wall 30, the top surfaces of the girders 40 contact the outer side of the inner wall 20 to correspond to a portion at which the cell structures 100 contact the inner wall 20 and flanges 41 of the girders 40 are welded to the plurality of outer walls 30.

The pressure tank may further comprise: gas sensors sensing gas between the inner wall 20 and the outer wall 30.

It is constructed by previously manufacturing structures having one wall surface of the inner wall 20 and the outer wall 30 or a combination of a plurality of wall surfaces thereof.

It is structurally stiffened and has improved heat insulating performance by filling concrete or heat insulating materials between the inner wall 20 and the outer wall 30.

The cell structures 1000 are previously manufactured as at least two pieces using a feature of a repeated structure and then are combined with each other at a construction place.

The cell structures 1000 have longer lattice units near the walls than the others units.

The tank body 50 are manufactured as the tank body with corners chamfered straight or curved 51, 52.

The exemplary embodiments of the present invention can a new type of high-pressure tank having essentially brick-like rectangular shape, that is, the pressure tank capable of enduring the high pressure of a fluid and the change in temperature while extending the size of the pressure tank in any dimension.

Further, the exemplary embodiments of the present invention can efficiently use the surrounding space by manufacturing the tank having the high volume efficiency, that is, manufacturing the tank in essentially brick-like rectangular shape.

In addition, the exemplary embodiments of the present invention can prevent the fluid from being leaked by mounting gas sensors between the outer wall and the inner wall of the pressure tank having the double layer wall structure.

In addition, the exemplary embodiments of the present invention can reduce the sloshing phenomenon due to the fluid by mounting the lattice-shaped structure in the tank.

BRIEF DESCRIPTION OF DRAWINGS

The above and other objects, features and advantages of the present invention will become apparent from the following description of preferred embodiments given in conjunction with the accompanying drawings, in which.

DETAILED DESCRIPTION OF MAIN ELEMENTS

Figure 1:
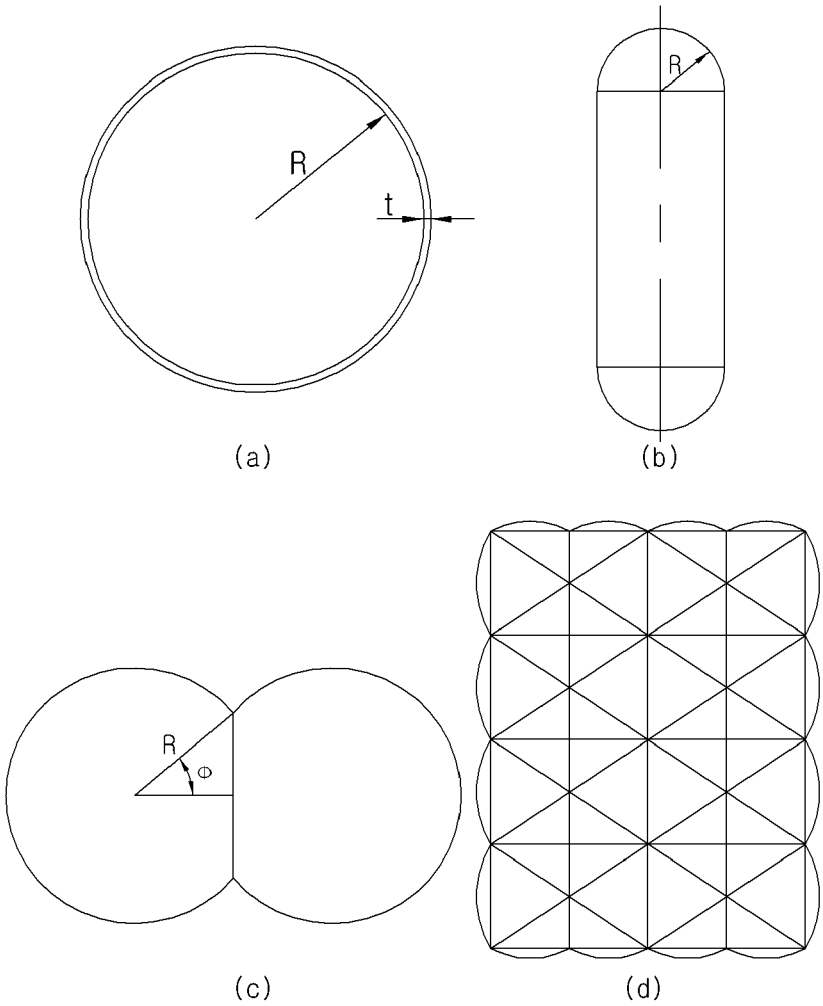
Figure 1 Prior Art
FIG. 1 is a cross-sectional view of a pressure tank according to the related art.

10: Pressure tank
20: Inner wall
21: wall stiffening member
22: beam-wall bracket
23: surface stiffening member
24: beam-beam bracket
30: Outer wall
40: Girder
41: Flange
50: Tank body
51: Tank body with corners chamfered straight.
52: Tank body with corners chamfered curvedly.
1000: Cell structure having load-carrying internal lattice structure
100: Surface lattice structure
110: Surface lattice unit
114: Intersecting part
120: Cell wall
121: First cell wall
122: Second cell wall
123: Third cell wall
200: Beam structure
210: Beam lattice unit
211: X-axis beam structure
212: Y-axis beam structure
213: Z-axis beam structure
214: Intersecting part
220: Quadrangular beam structure
230: Circular beam structure
231: Circular X-axis beam structure
232: Circular Y-axis beam structure
233: Circular Z-axis beam structure
240: Combined beam structure
241: Combined beam structure node
242: Beam
250: Offset beam structure
260: H-type beam structure
261: X-axis H-type beam structure
262: Y-axis H-type beam structure
263: Z-axis H-type beam structure
264: Central portion
270: Outer wall cover plate
280: Inner wall cover plate
290: X cell beam structure
300: Beam surface structure
310: Beam surface lattice unit
320: Cell wall
321: First cell wall 322: Second cell wall
323: Third cell wall 324: Cell wall hole
330: Cell beam
331: First cell beam
332: Second cell beam
333: Third cell beam
334: Cylindrical cell beam
335: Square cell beam
336: X-shape cell beam

DETAILED DESCRIPTION OF THE INVENTION

Hereinafter, technical ideas of the present invention will be described in more detail with reference to the accompanying drawings.

However, the accompanying drawings are only an example shown for explaining in more detail the technical idea of the present invention and therefore, the technical idea of the present invention is not limited to the accompanying drawings.

Figure 2:
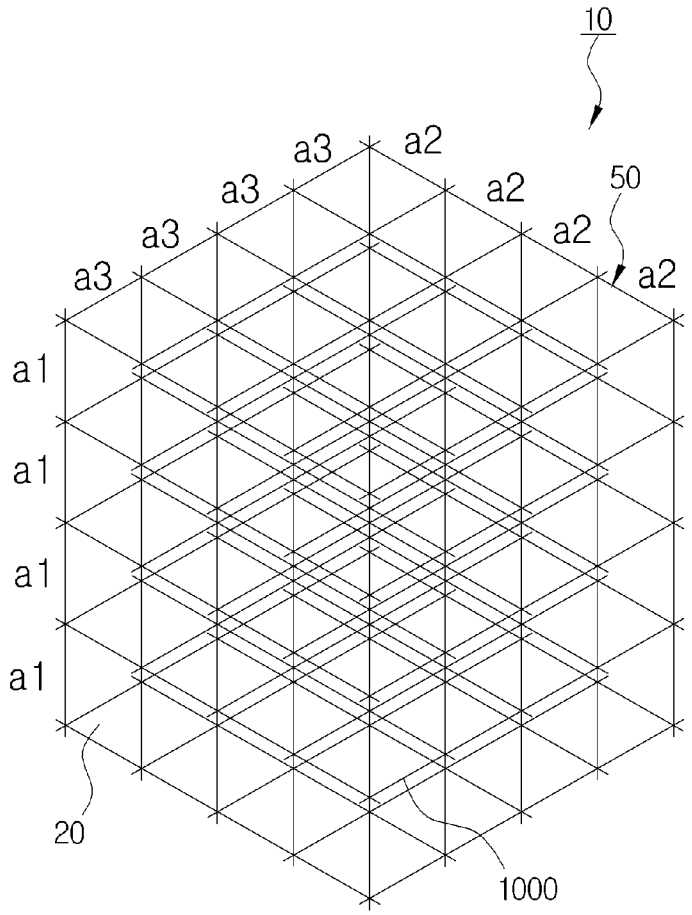
FIG. 2 is a schematic diagram of a tank with a load-carrying internal lattice structure according to an exemplary embodiment of the present invention.

A configuration and a shape of a pressure tank having a lattice structure according to an exemplary embodiment of the present invention will be described with reference to FIG. 2.

A pressure tank 10 according to the exemplary embodiment of the present invention includes a prismatic tank body 50 that has a high-pressure fluid accommodated therein and cell structures 1000 having load-carrying internal lattice structure that are disposed in the prismatic tank body 50, are manufactured in a lattice form, arrive from one side wall of the tank body 50 to the other side wall thereof facing it, and are orthogonally arranged regularly.

A configuration and a shape of a pressure tank having a surface lattice structure according to the exemplary embodiment of the present invention will be described with reference to FIGS. 3 and 4.

The cell structures 1000 having load-carrying internal lattice structure include surface lattice structures 100 that are manufactured to have a shape in which flat cell walls 120 intersect each other to endure a pressure load.

Figure 3:
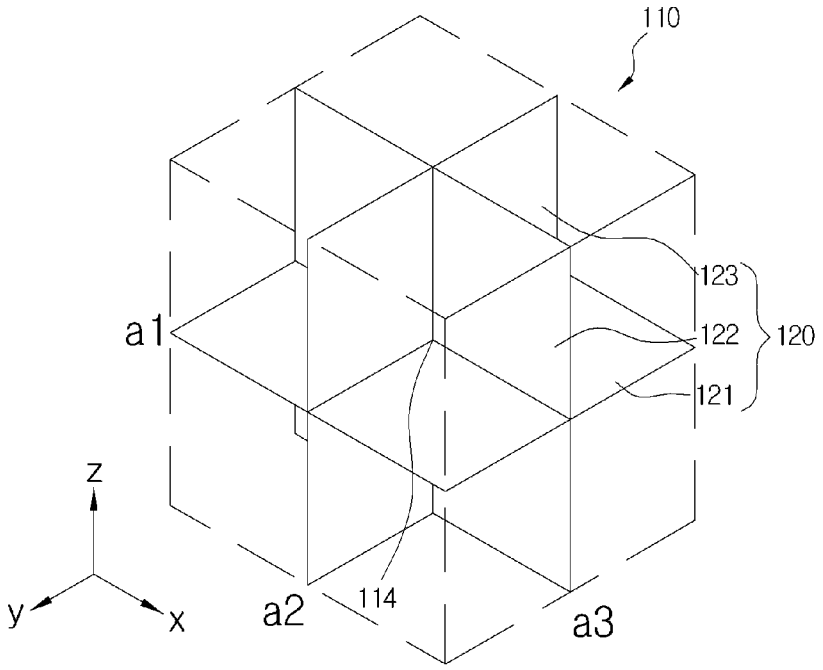
FIG. 3 is a perspective view of a surface lattice unit according to the exemplary embodiment of the present invention.
Figure 4:
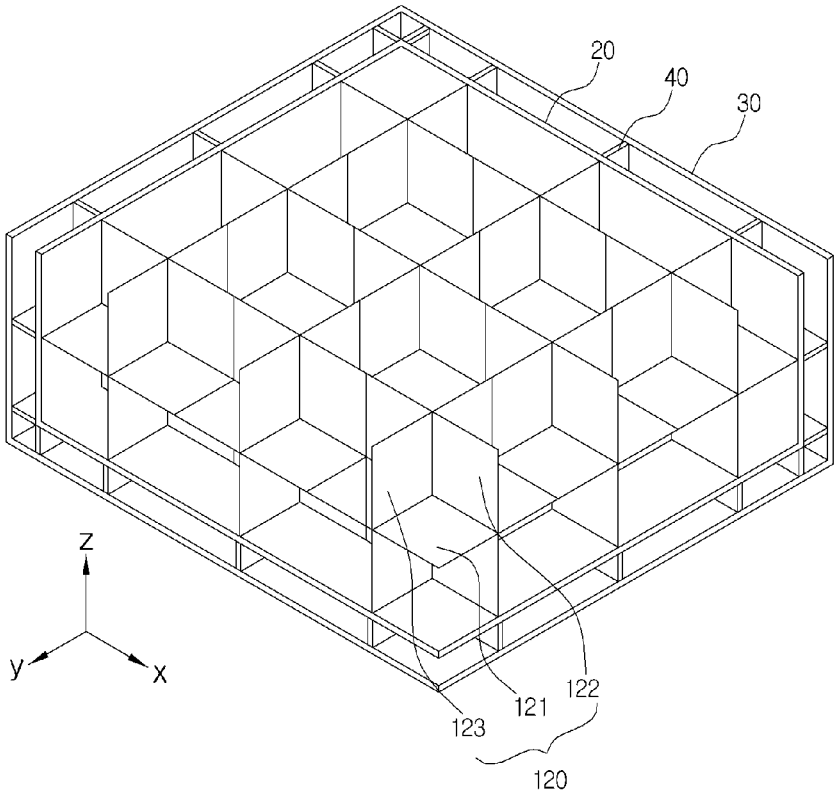
FIG. 4 is a partial perspective view of a surface lattice pressure tank according to the exemplary embodiment of the present invention.

When a single unit in which an intersecting part 114 is positioned at a rectangular parallelepiped central portion having each side of which the lengths are set to be a1, a2, and a3 is referred to as surface lattice units 110, the surface lattice structures 100 may be considered that the surface lattice units 110 are repeatedly formed (see FIG. 3).

Therefore, the overall shape of the surface lattice structures 100 may be derived from the description of the shape of the surface lattice units 110.

In more detail, the surface lattice structures 100 include a plurality of first cell walls 121 that are formed in parallel with an X-Y plane, a plurality of second cell walls 122 that are formed in parallel with a Y-Z plane, and a plurality of third cell walls 123 that are formed in parallel with a Z-X plane.

In addition, an end of the first cell wall 121 is contacted and fixed to a wall of the tank body 50 that is formed in parallel with the Y-Z plane and an inner wall of the pressure tank that is formed in parallel with a Z-X plane, an end of the second cell wall 122 is contacted and fixed to the wall of the tank body 50 that is formed in parallel with an X-Y plane and the inner wall of the tank body 50 that is formed in parallel with a Z-X plane, and the third cell wall 123 is fixed to the wall of the tank body 50 that is formed in parallel with the X-Y plane and the inner wall of the tank body 50 that is formed in parallel with the Y-Z plane.

Further, the first cell wall 121, the second cell wall 122, and the third cell wall 123 are each formed regularly at a predetermined distance and the surface lattice structures 100 include a plurality of intersecting parts 114 that are intersecting points at which the first cell wall 121, the second cell wall 122, and the third cell wall 123 meet one another.

Further, cell walls, which are provided with a plurality of holes (not shown), may be manufactured to communicate a fluid among different cells.

A configuration and a shape of a pressure tank having a beam structure according to the exemplary embodiment of the present invention will be described with reference to FIGS. 5 and 6.

In the pressure tank 10 having a lattice structure according to the exemplary embodiment of the present invention, the cell structures 1000 include beam structures 200.

The beam structures 200 arrive from one side wall of the tank body 50 to the other side wall thereof facing it and are orthogonally arranged regularly.

In more detail, the beam structures 200 include a plurality of X-axis beam structures 211 that are formed in an X-axis direction, a plurality of Y-axis beam structures 212 that are formed in a Y-axis direction, and a plurality of Z-axis beam structure 213 that are formed in a Z-axis direction.

Further, both ends of the X-axis beam structure 211 are fixed to the wall of the pressure tank 10 that is formed in parallel with the Y-Z plane, both ends of the Y-axis beam structure 212 are fixed to the wall of the pressure tank 10 that is formed in parallel with the Z-X plane, and both ends of the Z-axis beam structure 213 is fixed to the wall of the pressure tank 10 that is formed in parallel with the X-Y plane.

Further, the X-axis beam structure 211, the Y-axis beam structure 212, and the Z-axis beam structure 213 are each formed regularly at a predetermined distance and the beam structures 200 include a plurality of intersecting parts 214 that are intersecting points at which the X-axis beam structure 211, the Y-axis beam structure 212, and the Z-axis beam structure 213 meet one another.

Figure 5:
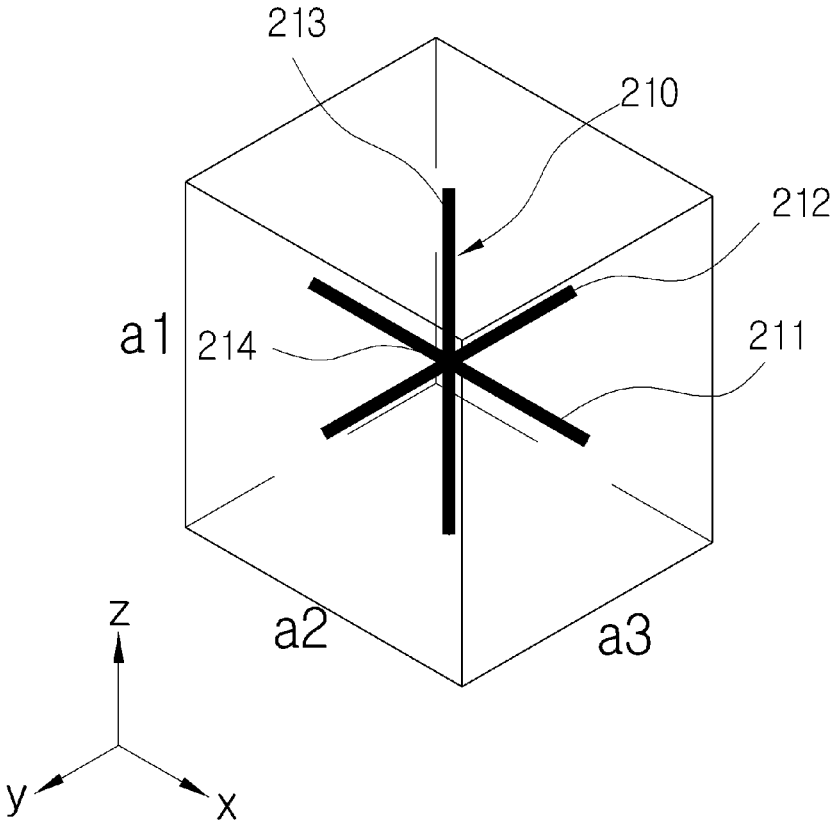
FIG. 5 is a perspective view of a beam lattice unit according to the exemplary embodiment of the present invention.

When a single unit in which the intersecting part 214 is positioned at a rectangular parallelepiped central portion having each side of which the lengths are set to be a1, a2, and a3 is referred to as beam lattice units 210, the beam structures 200 may be considered that the beam lattice units 210 are repeatedly formed (see FIG. 5).

Therefore, the overall shape of the beam structures 200 may be derived from the description of the shape of the beam lattice units 210.

Figure 6:
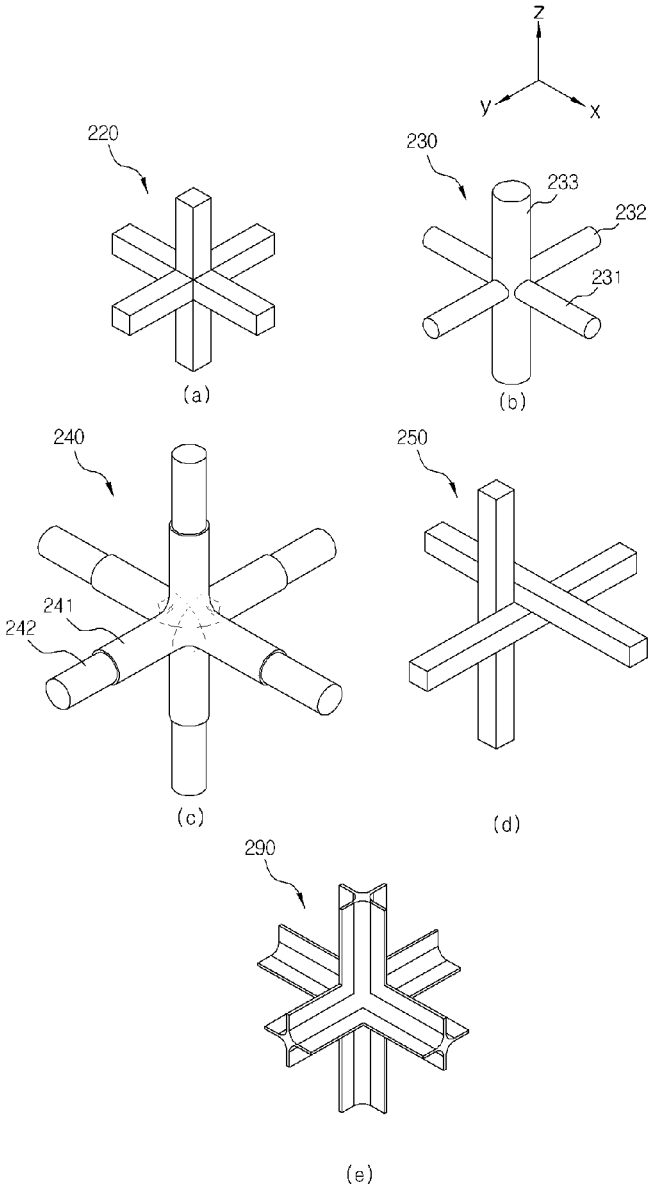
FIG. 6 is a perspective view of the beam lattice units according to the exemplary embodiment of the present invention.

FIG. 6 shows the beam lattice unit 210 that is a unit of the beam structures 200 according to the exemplary embodiment of the present invention.

The beam lattice unit 210 may be manufactured as a quadrangular beam structure 220 that has a rectangular section and is manufactured to have a structure in which the intersecting parts 214 meet one another (see (a) of FIG. 6).

The beam lattice unit 210 may be manufactured as a circular beam structure 230 of which the section is formed in a circular shape (see (b) of FIG. 6).

In this configuration, the circular beam structure 230 is configured to include a circular X-axis beam structure 231, a circular Y-axis beam structure 232, and a circular Z-axis beam structure 233, wherein a diameter of the Z-axis beam structure 233 may be manufactured to be larger than that of the circular X-axis beam structure 231 or the circular Y-axis beam structure 232 to more firmly endure force applied to the Z axis.

In (b) of FIG. 6, although the diameter of the circular Z-axis beam structure 233 is manufactured to be larger than those of the circular X-axis beam structure 231 and the circular Y-axis beam structure 232, the exemplary embodiment of the present invention is not limited to a single axis but may be manufactured by making the size of each of the X, Y, and Z-axis beam structures 231, 232, and 233 different.

The beam lattice unit 210 includes a combined beam structure node 241 in which the intersecting part 214 is manufactured to have a hollow shape and may be manufactured as a combined beam structure 240 by inserting a beam 242 into the combined beam structure node 241 (see (c) of FIG. 6).

The beam lattice unit 210 may be manufactured as an offset beam structure 250 that has the intersecting part 214 formed in an alternating structure and that is manufactured as an offset structure in which side portions of each beam meet one another (see (d) of FIG. 6).

The beam lattice unit 210 may be manufactured as an X cell beam structure 290 that has an X-shaped section and is manufactured, possibly prefabricated, to have a structure in which the intersecting parts 214 meet one another (see (e) of FIG. 6).

A configuration and a shape of a tank body 50 according to the exemplary embodiment of the present invention will be described with reference to FIG. 7.

The tank body 50 may have a double structure including an inner wall 20 and an outer wall 30.

In more detail, the tank body 50 includes the inner wall 20 that contacts the beam structures 200 and the outer wall 30 that is positioned at a predetermined distance from the inner wall 20.

Further, the tank body 50 includes a plurality of beam-wall brackets 22 that are positioned between the beam structures 200 contacting the inner wall 20, contact the inner side of the inner wall 20, have both sides contacting the beam structures 200, and have formed so that an opposite side contacting the inner wall 20 have a predetermined curvature.

The beam-wall brackets 22 are mounted to disperse the external force applied to the wall of the tank body 50. Herein, since the ends of the beam structures 200 may contact the inner wall 20 to concentrate stress, the mounted beam-wall brackets 22 are to disperse the force applied to the outside. (see FIG. 7)

The pressure tank may further include: a plurality of beam-beam brackets 24 that are welded into an intersecting part of the beams and have a predetermined curvature.

Therefore, the ends of the beam structures 200 are joined at the intersecting points at which the beam-wall brackets 22 meet each other, such that force is transferred from the beam structures 200 to the beam-wall brackets 22.

Figure 7:
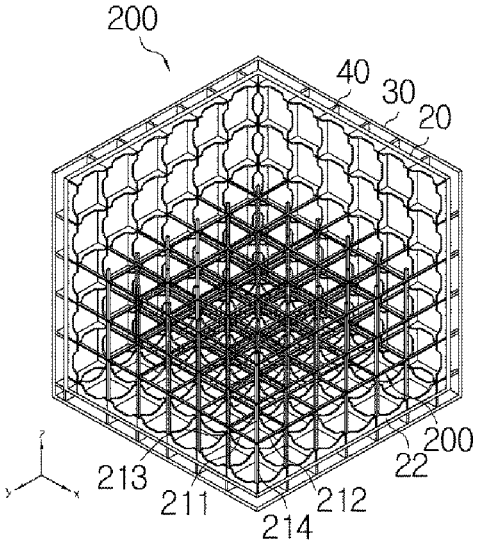
FIG. 7 is a partial perspective view of a beam lattice pressure tank according to the exemplary embodiment of the present invention.
Figure 7:
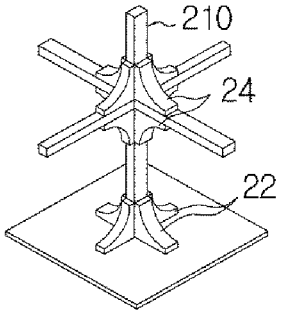

Further, when the ends of the beam structures 200 are joined to the intersecting points of the beam-wall brackets 22, the beam structure brackets are formed in the beam structures 200, such that the ends of the beam structures 200 and the beam-wall brackets 22 can be easily joined with each other (see enlarged view of FIG. 7).

Force is transferred to the inner wall 20 or the outer wall 30 of the pressure tank 10 from the beam structures 200 and the wall stiffening members 21 are additionally disposed on the inner wall 20 or the outer wall 30. Meanwhile, when the wall stiffening members 21 are disposed on the inner side or the outer side of the inner wall 20, the wall stiffening members 21 are preferably positioned in a lattice form between the beam-wall brackets 22.

In this case, the wall stiffening members 21 are preferably manufactured to have flanges for providing sufficient strength against warping (twisting).

In addition, the beam structures 200 are formed so that a length to the intersecting parts 214 from portions at which the beam structures 200 contact an inner side of the inner wall 20 is longer.

Figure 8:
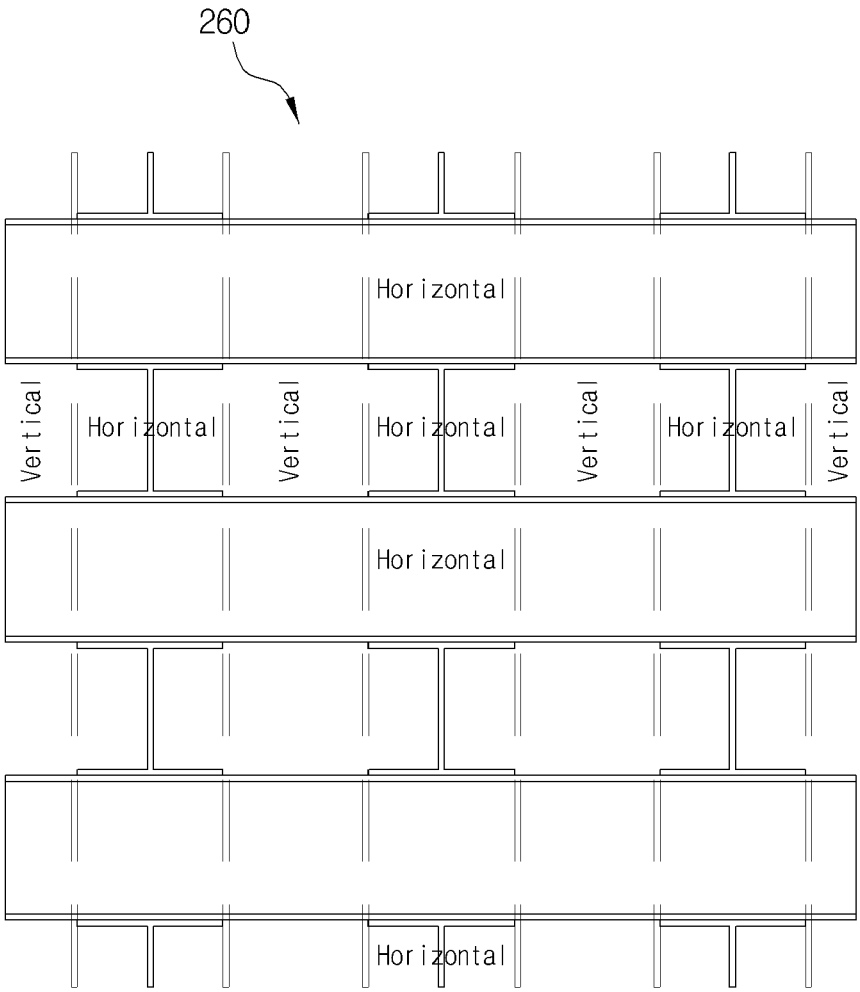
FIG. 8 is a cross-sectional view of the beam lattice pressure tank using H beams according to the exemplary embodiment of the present invention.
Figure 9:
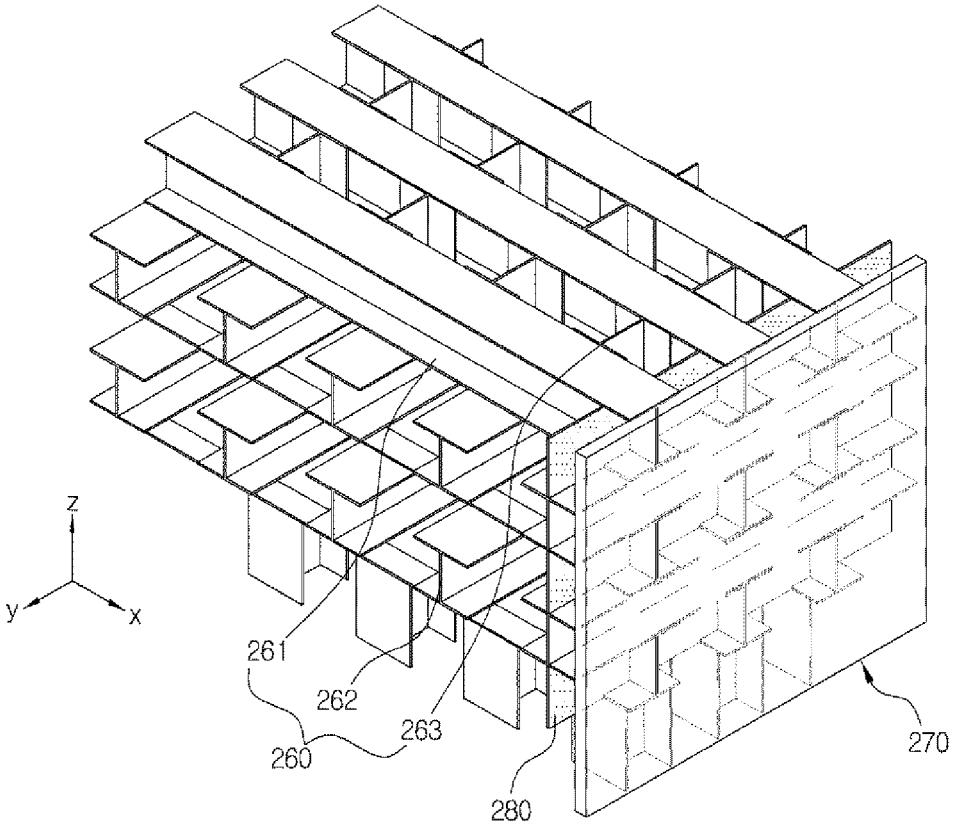
FIG. 9 is a partial perspective view of the beam lattice pressure tank using H beams according to the exemplary embodiment of the present invention.

FIGS. 8 and 9 are a partial plan view and a partial perspective view of the pressure tank 10 configured of H-type beam structures 260 according to the exemplary embodiment of the present invention.

The pressure tank 10 configured of the H-type beam structures 260 according to the exemplary embodiment of the present invention includes a tank body 50 that has a high-pressure fluid accommodated therein and is manufactured to have a prismatic shape; and the plurality of H-type beam structures 260 that are disposed in the prismatic tank body 50, are manufactured in a lattice form, arrive from one side wall of the tank body 50 to the other side wall thereof facing it, are orthogonally arranged regularly, and have a I-type or an H-type section.

In more detail, the H-type beam structures 260 include a plurality of X-axis H-type structures 261 formed in an X-axis direction, a plurality of Y-axis H-type structures formed in a Y-axis direction, and a plurality of Z-axis H-type structures 263 formed in a Z-axis direction.

Further, the H-type beam structures 260 are densely positioned.

The H-type beam structures 260 are alternately formed without the intersecting points, like the above-mentioned offset beam structures 250.

In more detail, when sides of the X-axis H-type beam structures 261 contact the Y-axis H-type beam structures 262, the other sides of the X-axis H-type beam structures 261 continuously contact the Y-axis H-type beam structures 262.

Although the above-mentioned contents describe, for example, the X-axis H-type beam structures 261 and the Y-axis H-type beam structures 262, the Y-axis H-type beam structures 262 and the Z-axis H-type beam structures 263 and the X-axis H-type beam structures 261 and the Z-axis H-type beam structures 263 are densely positioned to have the same configuration.

Further, the ends of the H-type beam structures 260 are provided with an outer wall cover plate 270 to form the outer wall 30 of the pressure tank and central portions 261 of the H-type beam structures 260 having side portions contacting the outer wall 30 extend vertically to form the inner wall 20 of the pressure tank 10.

In more detail, when the side portions of the Y-axis H-type beam structures 262 contact the inner side of the outer wall cover plate 270 and the ends of the X-axis H-type beam structures 261 contact the inner side of the outer wall cover plate 270 based on the outer wall cover plate 270 that are formed in parallel with the YZ plane, the inner wall cover plate 280 forms the inner wall by vertically extending the central portion 264 of the X-axis H-type beam structure 261.

Although the above-mentioned contents describe how to form the inner wall cover plate 280 based on the outer wall 30 formed in parallel with the YZ plane, the outer wall 30 and the inner wall 20 formed in parallel with the X-Y plane and the Z-X plane are formed in the same manner.

In the pressure tank 10 having a lattice structure according to the exemplary embodiment of the present invention, the cell structures 1000 include the beam surface structures 300.

Figure 10:
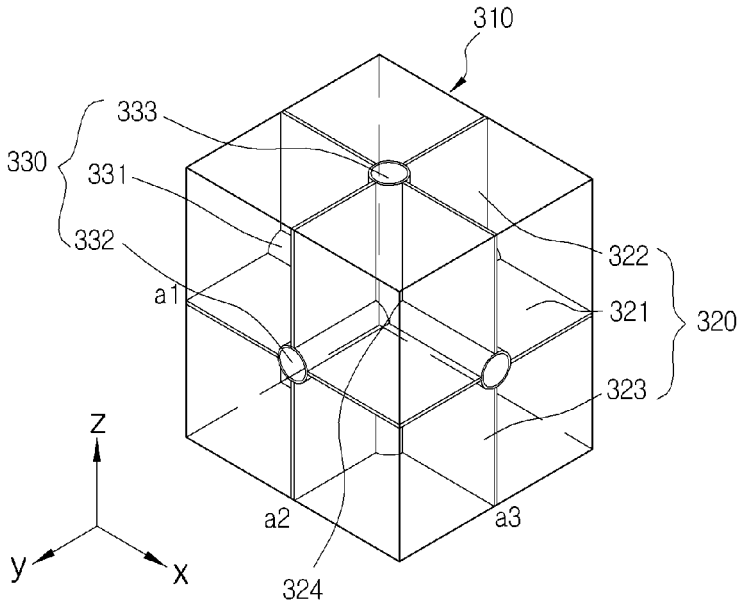
FIG. 10 is a perspective view of a beam surface lattice unit according to the exemplary embodiment of the present invention.

The beam surface structures 300 according to the exemplary embodiment of the present invention will be described with reference to FIG. 10.

The beam surface structures 300 are configured to include flat cell walls 320 that arrive from one side wall of the pressure tank 10 to the other side wall thereof facing it and are orthogonally arranged regularly and intersect each other and cell beams 330 positioned at points at which the cell walls 320 intersect each other.

The cell beams 330 are manufactured as branching type cell beams 334, 335, and 336.

In more detail, the branching type cell beams 334, 335, and 336 include beams that extend in a three-dimensional orthogonal coordinate system (X, Y, and Z) structure. In other words, the cell beams 330 include a plurality of first cell beams 331 formed in an X-axis direction, a plurality of second cell beams 332 formed in a Y-axis direction, and a plurality of third cell beams 333 formed in a Z-axis direction.

Further, both ends of the first cell beams 331 are contacted and fixed to the wall of the pressure tank 10 formed in parallel with the Y-Z plane, both ends of the second cell beams 332 contact the wall of the pressure tank 10 formed in parallel with the Z-X plane, and both ends of the third cell beams 333 contact the wall of the pressure tank 10 formed in parallel with the X-Y plane.

Further, the first cell beams 331, the second cell beams 332, and the third cell beams 333 are each formed regularly at a predetermined distance and the cell beams 330 include a plurality of intersecting parts 334 that are the intersecting points at which the first cell axes 331, the second cell axes 332, and the third cell axes 333 meet one another.

Further, the cell walls 320 includes a plurality of first cell surfaces 321 that are formed on the X-Y plane on which the first cell beams 331 and the second cell beams 332 intersect each other and contact the first cell beams 331 and the second cell beams 332, a plurality of second cell surfaces 322 that are formed on the Y-X plane on which the second cells beams 332 and the third cell beams 333 intersect each other and contact the second cell beams 332 and the third cell beams 333, and a plurality of third cell surfaces 323 that are formed on the Z-X plane on which the first cell beams 331 and the third cell beams 333 intersect each other and contact the first cell beams 331 and the third beams 333.

When the single unit in which the intersecting parts 334 are positioned the central portion of the rectangular parallelepiped shape having each side of which the lengths are set to be a1, a2, and a3 is referred to as a beam surface lattice unit 310, the beam surface structures 300 may be considered that the beam surface lattice unit 310 are repeatedly formed.

Therefore, the overall shape of the cell structures 300 may be derived from the shape of the beam surface lattice unit 310.

Figure 11:
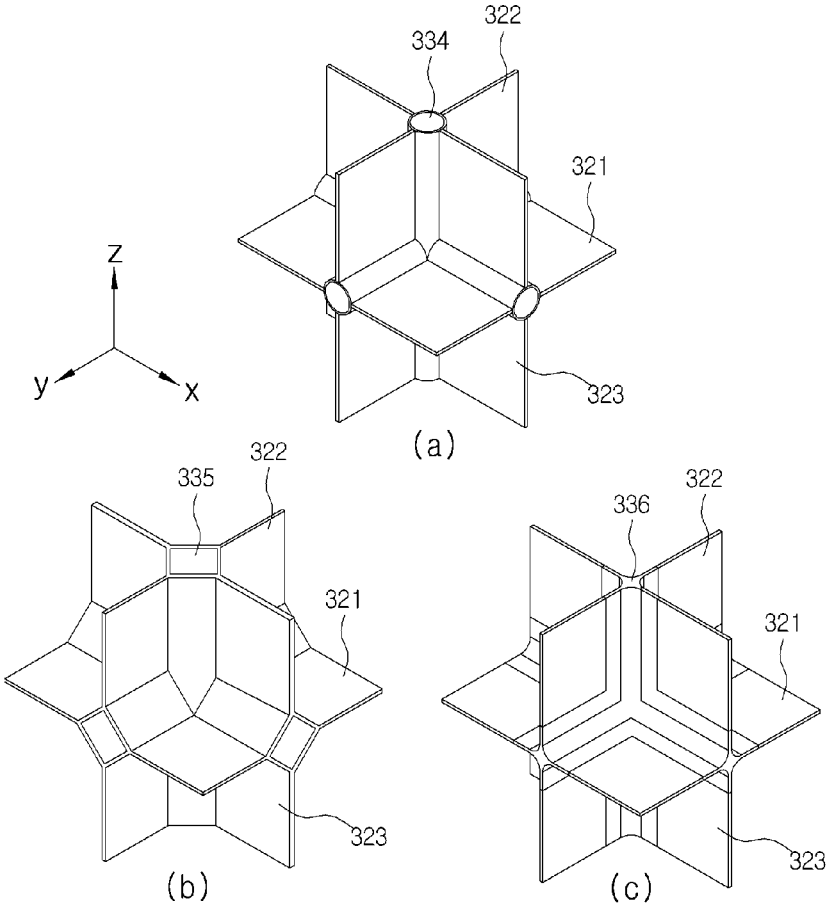
FIG. 11 is a perspective view of beam surface lattice units according to the exemplary embodiment of the present invention.

FIG. 11 shows the exemplary embodiment of the beam surface structures 300 according to the exemplary embodiment of the present invention and shows the unit lattice 310 that is the unit of the beam surface structure 300.

The sections of the cell beams 330 may be manufactured as circular cell beams 334 formed in a circular shape (see (a) of FIG. 11).

Figure 12:
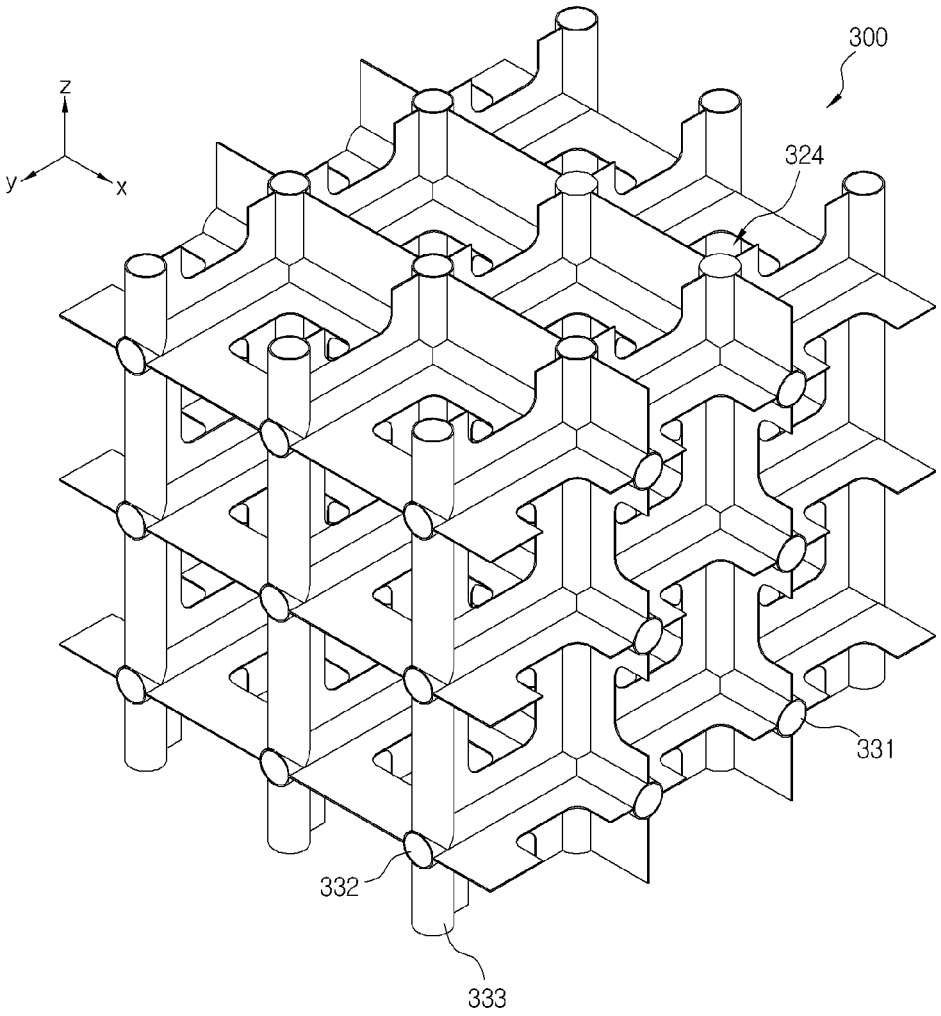
FIG. 12 is a perspective view of a beam surface lattice pressure tank according to the exemplary embodiment of the present invention.

The cell beams 330 may be manufactured as diamond-shaped cell beams 335 of which the sections have a diamond shape and may be manufactured so that corners of the diamond-shaped cell beams 335 contact the cell walls 320 (see FIG. 12B).

The cell beams 330 may be manufactured as the "X"'-shaped cell beams 336 and may be manufactured so that the side portions of the X cell beams 336 contact the cell walls 320 (see FIG. 13C).

Figure 13:
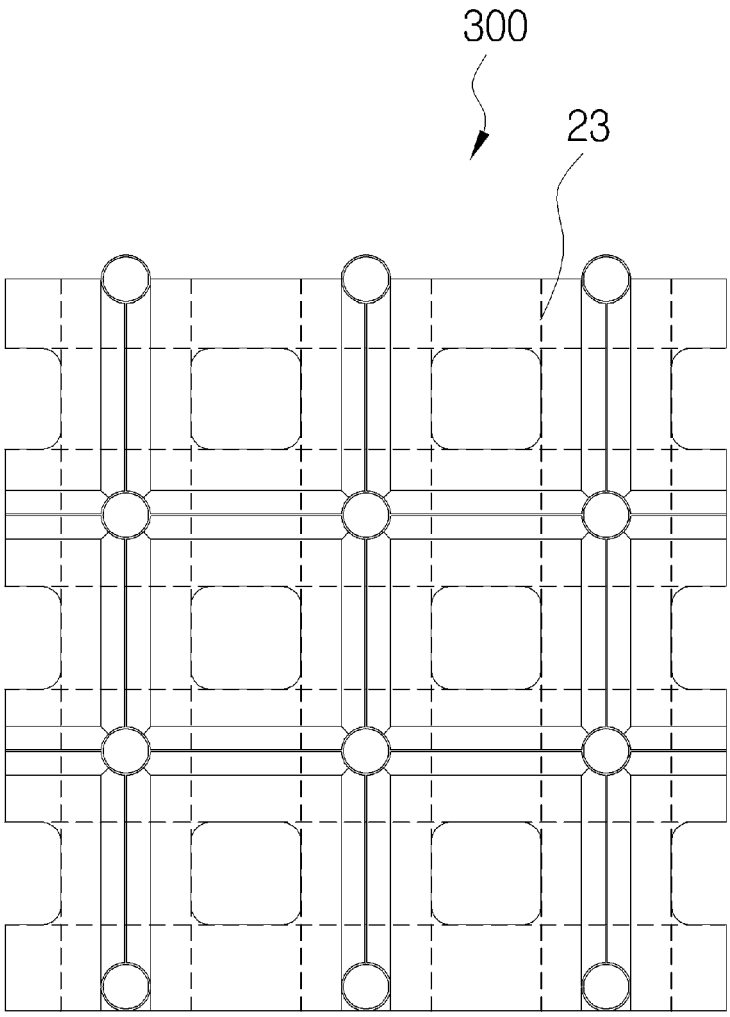
FIG. 13 is a plan view of the beam surface lattice structure according to the exemplary embodiment of the present invention.

The cell walls 320 according to the exemplary embodiment of the present invention will be described with reference to FIGS. 13 and 14.

The cell walls 320, which are provided with quadrangular cell wall holes 324 having rounded corners, may be manufactured to communicate a fluid among different cells.

In addition, the beam surface structures 300 further include surface stiffening members 23 that intersect each other so as to be orthogonally arranged regularly at boundary surfaces of the cell wall holes 324 and contact the cell walls 320.

In this case, the surface stiffening members 23 are manufactured to have flanges for sufficient strength against warping.

Figure 14:
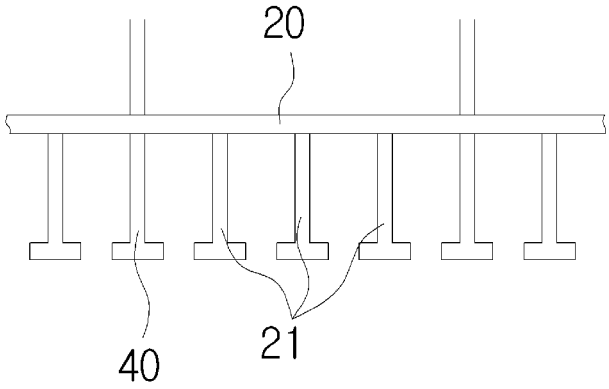
FIG. 14 is a cross-sectional view of a wall surface of the lattice pressure tank with stiffeners according to the exemplary embodiment of the present invention.

FIG. 14 shows a cross-sectional view of the inner wall and the outer wall of the pressure tank according to the exemplary embodiment of the present invention.

The tank body 50 has a double structure configured of the inner wall 20 and the outer wall 30.

In more detail, the tank body 50 includes the inner wall 20 contacting the cell structures 1000 and the outer wall 30 positioned at a predetermined distance from the inner wall 20.

Further, the inner wall 20 and the outer wall 30 may be preferably made of a material having pressure-resistant property and being suitable for all applicable temperatures.

Further, the plurality of girders 40 having a plate shape are disposed between the inner wall 20 and the outer wall 30 and the girders 40 contact the outer side of the inner wall 20 to correspond to portions at which the cell structures 100 contact the inner wall 20 and the other sides thereof contact an inner side of the outer wall 30.

Figure 15:
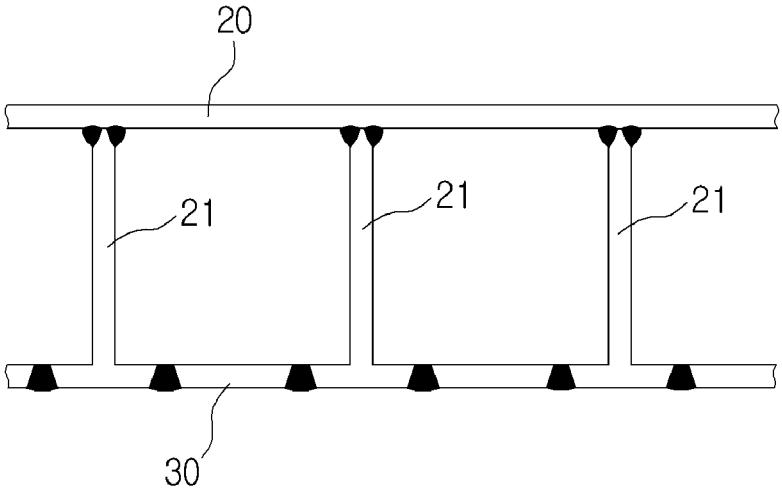
FIG. 15 is a diagram of wall surface of a lattice pressure tank according to a first exemplary embodiment of the present invention.

In the tank body 50, the plurality of girders 40 are disposed the inner wall 20 and the outer wall 30, the top surfaces of the girders 40 contact the outer side of the inner wall 20 to correspond to a portion at which the cell structures 100 contact the inner wall 20 and the side of flanges of the girders 40 are welded to the side of outer walls 30 (see FIG. 15)

Figure 16:
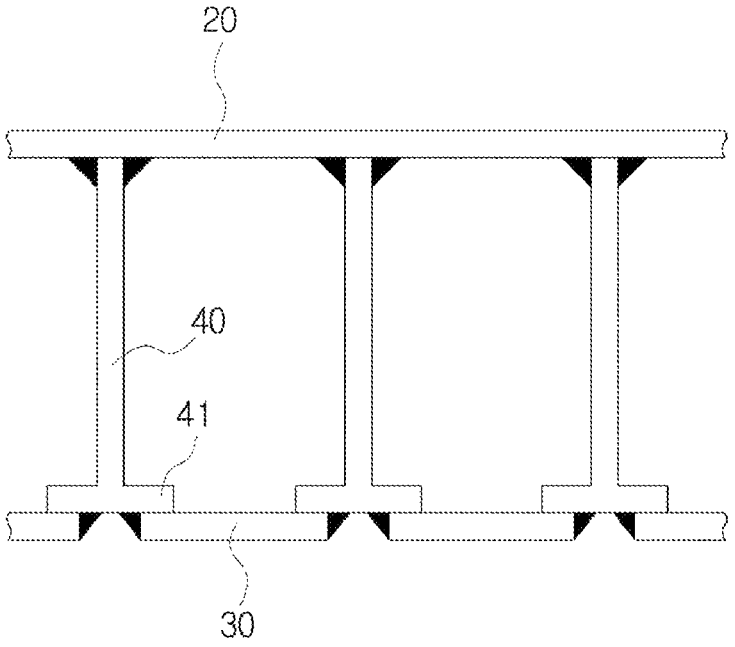
FIG. 16 is a diagram of wall surface of a lattice pressure tank according to a second exemplary embodiment of the present invention.
Figure 17:
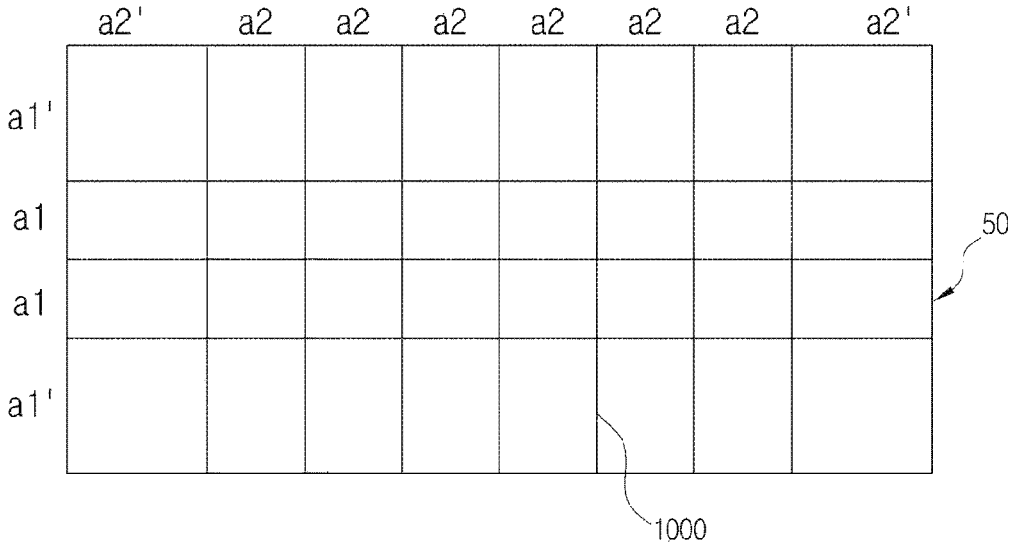
FIG. 17 is a schematic diagram of the cross-section of a tank with a cell structure whose lattice units near the walls longer than the others according to an exemplary embodiment of the present invention.

In the tank body 50, the plurality of girders 40 are disposed between the inner wall 20 and the outer wall 30, the top surfaces of the girders 40 contact the outer side of the inner wall 20 to correspond to a portion at which the cell structures 100 contact the inner wall 20 and the flanges 41 of the girders 40 are welded to the plurality of outer walls 30 (see FIG. 16).

An example of the welding method may include butt welding, fillet welding, or the like.

That is, in the case of the tank body 50 having a narrow double wall, a person cannot enter between the inner wall 20 and the outer wall 30 due to a narrow interval between the inner wall 20 and the outer wall 30, such that he/she cannot perform any work. As a result, the top of the girder 40 may be welded to the outer side of the inner wall 20 and then, the flange 41 is welded to the outer wall 30 at the outer side of the outer wall 30 to form the outer wall 30. An example of the welding method may include butt welding, fillet welding, or the like.

In this case, the flange 41 is made of heavy materials and thus, closely connected with the outer wall 30.

Further, the inner wall 20 or the outer wall 30 is provided with the wall stiffening members 21, such that the wall stiffening member 21 is positioned at the inner side or the outer side of the inner wall 20.

In this case, the wall stiffening members 21 are preferably manufactured to have flanges for providing sufficient strength against warping (see FIG. 14).

In addition, at least one gas sensor (not shown) that may sense gas is positioned between the inner wall 20 and the outer wall 30 to immediately sense and warn against a fluid leaked due to cracks occurring in the inner wall 20.

Further, the outer side of the outer wall 30 is provided with the heat insulating layer to prevent the internal heat of the pressure tank 10 from being discharged to the outside.

Further, the pressure tank is constructed by previously manufacturing the structures in which one wall surface of the inner wall 20 and the outer wall 30 or a combination of a plurality of wall surfaces thereof are formed.

In addition, the pressure tank is structurally stiffened and has improved heat insulating performance by filling concrete or heat insulating materials between the inner wall 20 and the outer wall 30.

In this case, the heat insulating composite material may be made of fiber glass reinforced plastics (FRP), polymer compound, or the like.

In addition, the cell structures 1000 have a repeated structure to complete the single completed cell structure 100 by being combined with one another at a construction place by previously manufacturing and constructing at least two pieces.

Figure 18:
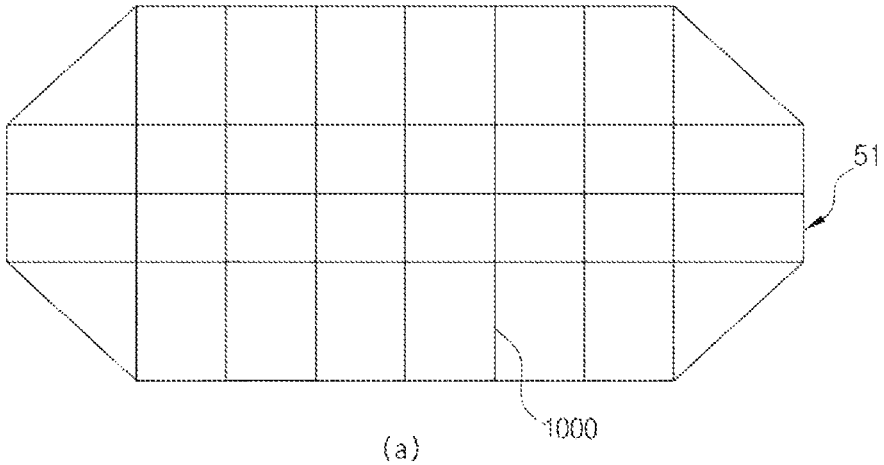
FIG. 18 is a tank body whose corners are chamfered straight according to a first exemplary embodiment of the present invention.
Figure 18:
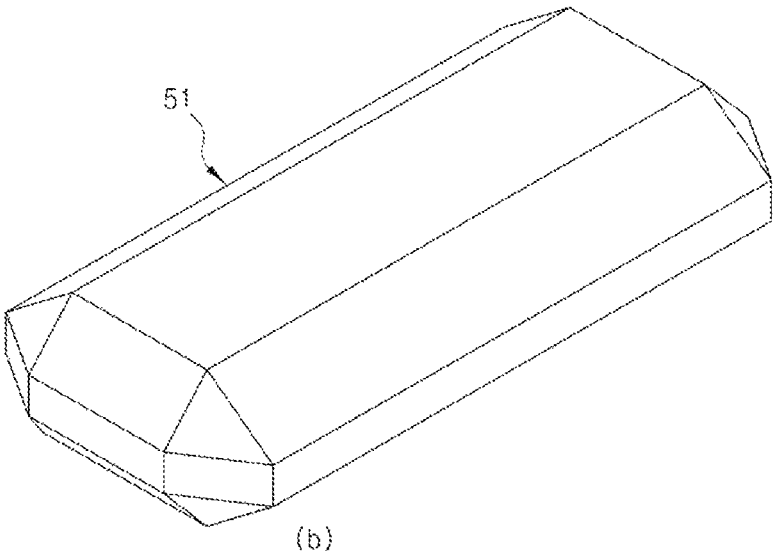
Figure 19:
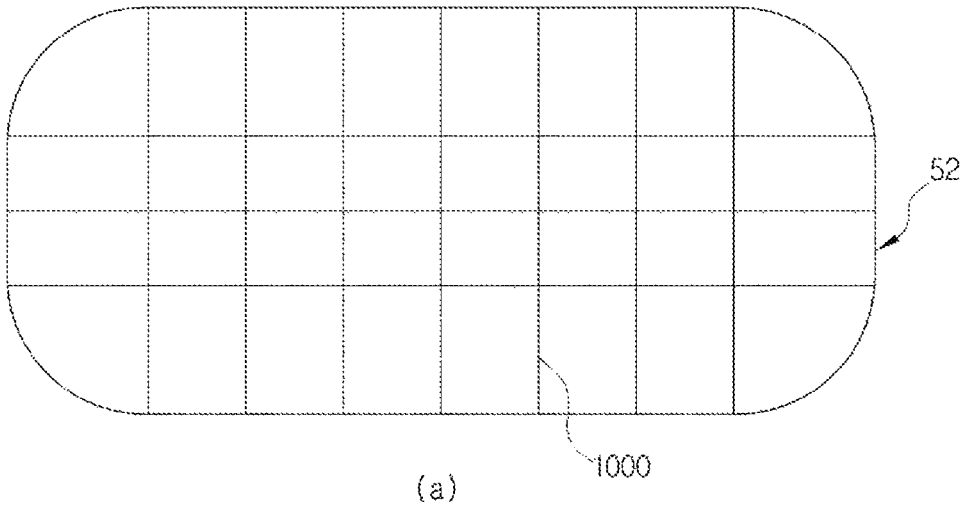
FIG. 19 is a tank body whose corners are chamfered curved according to a second exemplary embodiment of the present invention.
Figure 19:
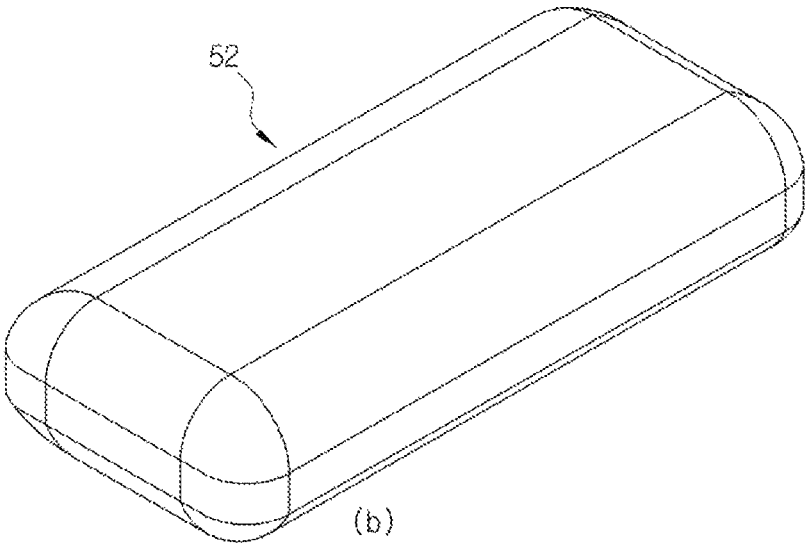

The basic hexagonal shape may be modified into more general prismatic shapes at the same time as the principle of an internal orthogonal load carrying mesh is maintained. The most typical case will be to cut off corners of the hexagon with chamfer planes consistent with the internal lattice grid; such planes will most typically be at a 45 degree angle in relation to the hexagonal planes. A main reason for introducing chamfer corner is to be able to satisfy external geometric restrictions such as the internal shape of a hold in a ship. Another reason, and this particularly applies to very large tanks, is to reduce deformations and local bending in the corner regions by exploiting the high in-plane stiffness of the chamber plates. In some cases one might consider curved chamfer zones although they will typically have less in-plane stiffness. (see FIGS. 18 and 19)

Therefore, the pressure tank 10 according to the exemplary embodiment of the present invention is a new type of high-pressure low-temperature tank having a prismatic-shape. That is, the lattice beam pressure tank 10 can endure the high pressure of a fluid and the change in temperature while extending a size of the pressure tank in any dimension.

Further, the exemplary embodiments of the present invention can efficiently use the surrounding space by manufacturing the tank having the high volume efficiency, that is, manufacturing the tank in principally a prismatic-shape.

In addition, the exemplary embodiments of the present invention can prevent the fluid from being leaked by mounting gas sensors between the outer wall 30 and the inner wall 20 of the pressure tank having the double wall structure. The outer wall may also be designed as a full secondary barrier to be able to withstand significant pressure in case of leakage through the inner wall.

In addition, the exemplary embodiments of the present invention can reduce the sloshing phenomenon due to motion of the internal fluid by mounting the lattice-shaped cell structure 100 in the tank body 50 and disperse the force applied to the outer wall 20 and the inner wall 30 of the tank body 50.

What is claimed is:

1. A pressure tank having a lattice structure, comprising:

a tank body that has a high-pressure fluid accommodated therein and has a prismatic shape; and cell structures that are disposed in the tank body, have a lattice form, arrive from a first side wall of the tank body to a second side wall thereof facing the first side wall, and are orthogonally arranged, wherein the cell structures include beam surface structures having flat cell walls that arrive from the first side wall of the tank body to the second side wall thereof facing the first side wall and are orthogonally arranged to intersect with each other and cell beams that are positioned at a point at which the cell walls intersect each other, wherein the cell beams are branching type cell beams, wherein the branching type cell beams include beams that extend in a three-dimensional orthogonal coordinate system (X, Y, and Z) structure, and wherein the cell beams are circular cell beams each having circular sections, or diamond-shaped cell beams each having diamond-shaped sections and corners of the diamond-shaped cell beams contact the cell walls.

2. The pressure tank of claim 1, wherein the cell walls are provided with quadrangular cell wall holes comprising corners that are rounded.

3. The pressure tank of claim 2, further comprising: surface stiffening members that contact top surfaces or bottom surfaces of the cell walls and are orthogonally arranged at boundary surfaces of the cell wall holes to intersect with each other, and the surface stiffening members have girders with flanges.

4. The pressure tank of claim 1, wherein the cell beams are circular cell beams each having circular sections.

5. The pressure tank of claim 1, wherein the cell beams are diamond-shaped cell beams each having diamond-shaped sections and corners of the diamond-shaped cell beams contact the cell walls.

6. A pressure tank having a lattice structure, comprising:

a tank body that has a high-pressure fluid accommodated therein and has a prismatic shape; and cell structures that are disposed in the tank body, have a lattice form, arrive from a first side wall of the tank body to a second side wall thereof facing the first side wall, and are orthogonally arranged, wherein the cell structures include cell walls orthogonally arranged to intersect with each other, and wherein the tank body includes an inner wall contacting the cell structures and an outer wall positioned at a predetermined distance from the inner wall, the outer wall not contacting the cell structures.

7. The pressure tank of claim 6, wherein at least one of an inner side of the inner wall, an outer side of the inner wall, an inner side of the outer wall, and an outer side of the outer wall is provided with a wall stiffening member having a lattice form, the wall stiffening member is a girder with flanges and has an upper surface joined to the inner wall or the outer wall.

8. The pressure tank of claim 6, wherein a plurality of girders with flanges are disposed between the inner wall and the outer wall, the top surfaces of the girders contact an outer side of the inner wall to correspond to a portion at which the cell structures contact the inner wall and flanges of the girders are welded to the outer wall.

9. The pressure tank of claim 6, further comprising: gas sensors sensing gas between the inner wall and the outer wall.

10. The pressure tank of claim 6, wherein the pressure tank comprises structures having one wall surface of the inner wall and the outer wall or a combination of a plurality of wall surfaces thereof.

11. The pressure tank of claim 6, wherein the pressure tank is structurally stiffened and has improved heat insulating performance by filling concrete or heat insulating materials between the inner wall and the outer wall.

12. A pressure tank having a lattice structure, comprising:

a tank body that has a high-pressure fluid accommodated therein and has a prismatic shape; and cell structures that are disposed in the tank body, have a lattice form, arrive from a first side wall of the tank body to a second side wall thereof facing the first side wall, and are orthogonally arranged, wherein the tank body includes an inner wall contacting the cell structures and an outer wall positioned at a predetermined distance from the inner wall, and wherein a plurality of girders having a plate shape are disposed between the inner wall and the outer wall, the girders contacting an outer side of the inner wall to correspond to portions at which the cell structures contact the inner wall and the other sides thereof contacting an inner side of the outer wall.

* * * * *